US007365694B2

(12) United States Patent
Inaba et al.

(10) Patent No.: US 7,365,694 B2
(45) Date of Patent: Apr. 29, 2008

(54) ANTENNA UNIT WHICH CAN BE DESIGNED TO BE SMALL IN SIZE

(75) Inventors: Toshihiko Inaba, Akita (JP); Toshiaki Aizawa, Akita (JP); Junichi Noro, Akita (JP)

(73) Assignee: Mitsumi Electric Co., Ltd., Tama-shi (JP)

( * ) Notice: Subject to any disclaimer, the term of this patent is extended or adjusted under 35 U.S.C. 154(b) by 61 days.

(21) Appl. No.: 11/322,197

(22) Filed: Dec. 29, 2005

(65) Prior Publication Data

US 2006/0202905 A1 Sep. 14, 2006

(30) Foreign Application Priority Data

Mar. 14, 2005 (JP) ..... 2005-70663

(51) Int. Cl.
*H01Q 1/32* (2006.01)

(52) U.S. Cl. ..... 343/713; 343/711

(58) Field of Classification Search ..... 343/711, 343/712, 713, 715, 872, 700 MS
See application file for complete search history.

(56) References Cited

U.S. PATENT DOCUMENTS 3,977,005 A * 8/1976 Cejka ..... 343/715
6,486,841 B1 * 11/2002 Imahigashi ..... 343/715
2003/0137463 A1 * 7/2003 Shimizu ..... 343/713

* cited by examiner

*Primary Examiner*—Hoang V Nguyen
*Assistant Examiner*—Robert Karacsony
(74) *Attorney, Agent, or Firm*—Frishauf, Holtz, Goodman & Chick, P.C.

(57) ABSTRACT

In an antenna unit including an antenna and a bottom plate, a unit fixing member is disposed between the antenna and the bottom plate. The unit fixing member is adapted to provisionally fix the antenna unit onto a mobile object and to fix the antenna onto the bottom plate.

12 Claims, 3 Drawing Sheets

ANTENNA UNIT WHICH CAN BE DESIGNED TO BE SMALL IN SIZE

This application claims priority to prior Japanese patent application JP 2005-70663, the disclosure of which is incorporated herein by reference.

BACKGROUND OF THE INVENTION

This invention relates to an antenna unit and, in particular, to an antenna unit for receiving a radio wave from an artificial satellite (which may be called a "satellite wave" hereinafter) or a radio wave from a ground station (which may be called a "ground wave" hereinafter).

In recent years, a digital radio receiver for receiving a satellite wave or a ground wave so as to listen to digital radio broadcasting has been developed and is put into practical use in United States of America. Specifically, two broadcasting stations called XM and Sirius provide radio programs on 250 or more channels in total. The digital radio receiver is generally mounted on a mobile object such as an automobile and is adapted to receive a radio wave having a frequency of about 2.3 GHz as a reception radio wave to listen to the digital radio broadcasting. In other words, the digital radio receiver is a radio receiver capable of listening to mobile broadcasting. Since the frequency of the reception radio wave is about 2.3 GHz, a reception wavelength (resonance wavelength) $\lambda$ is about 128.3 mm. It is noted here that the ground wave is a radio wave obtained by receiving the satellite wave at a ground station, slightly shifting the frequency of the satellite wave, and re-transmitting the satellite wave as a linear polarized wave. Thus, the ground wave is the linear polarized wave exhibiting linear polarization while the satellite wave is a circular polarized wave exhibiting circular polarization.

An XM satellite radio antenna apparatus normally serves to receive circular polarized radio waves from two stationary satellites and, in an insensitive zone of the circular polarized radio waves, receives a radio wave by using a ground linear polarization portion of the radio antenna apparatus. On the other hand, a Sirius satellite radio antenna apparatus normally serves to receive circular polarized radio waves from three orbiting satellites (synchronous type) and, in the insensitive zone, receives a radio wave by a ground linear polarization portion of the radio antenna apparatus.

As described above, the radio wave having the frequency of about 2.3 GHz is used in the digital radio broadcasting. Therefore, an antenna for receiving the radio wave must be located outside as known in the art. If the digital radio receiver is mounted to the mobile object such as the automobile, the antenna unit must be attached to a roof of the mobile object (car body).

The antenna unit comprises an antenna and an antenna case for covering the antenna. The antenna case comprises a dome-like top cover and a bottom plate. The antenna comprises an antenna element, a circuit board, and a shield case. For example, the antenna element comprises a patch antenna and receives the satellite wave. The circuit board is provided with a circuit (hereinafter will be called a signal processing circuit) for performing various kinds of signal processing, such as signal amplification, upon a signal received by the antenna element. The shield case serves to shield the signal processing circuit.

In the antenna unit already known, a mechanism (unit fixing member) for fixing the antenna unit to the roof of the mobile object (car body) must be formed by a component inside the antenna case. Furthermore, the antenna must be disposed inside the antenna case so that another component (antenna fixing member) for fixing the antenna to the bottom plate is required also. Thus, the antenna unit already known requires the two components, i.e., the unit fixing member and the antenna fixing member so that a required space inside the antenna case is increased. As a result, the antenna case is adversely affected in designability.

SUMMARY OF THE INVENTION

It is therefore an object of this invention to provide an antenna unit which can be designed to be small in size and excellent in designability.

Other objects of the present invention will become clear as the description proceeds.

According to an aspect of the present invention, there is provided an antenna unit comprising an antenna, a bottom plate, and a unit fixing member disposed between the antenna and the bottom plate, the unit fixing member being adapted to provisionally fix the antenna unit onto a mobile object and to fix the antenna onto the bottom plate.

DESCRIPTION OF THE PREFERRED EMBODIMENT

Figure 1:
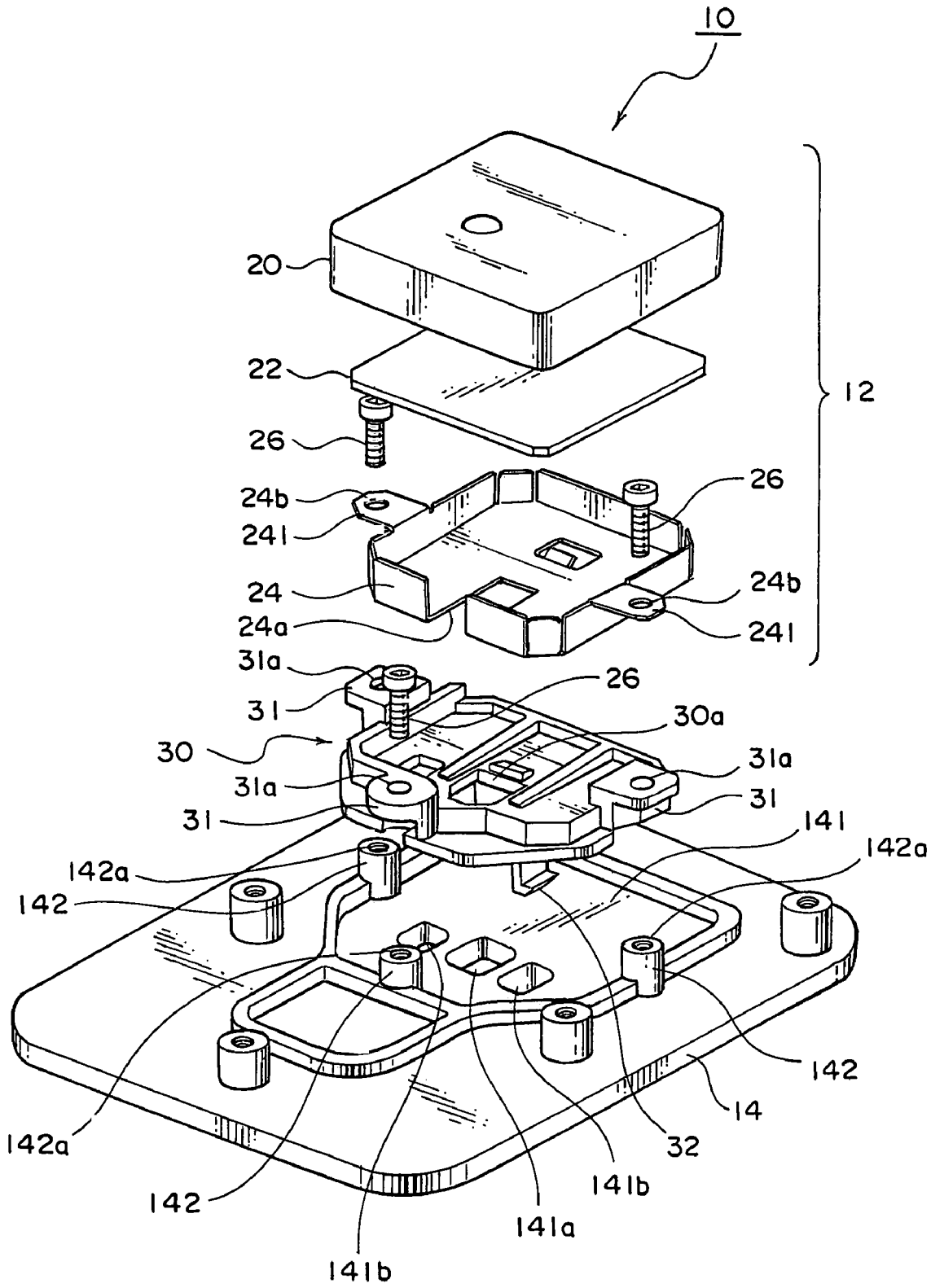
FIG. 1 is an exploded perspective view of an antenna unit according to one embodiment of this invention.

Referring to FIG. 1, description will be made of an antenna unit 10 according to one embodiment of this invention. The antenna unit 10 illustrated in the figure is an antenna apparatus for a digital radio receiver and is mounted to a roof of a mobile object (car body) such as an automobile.

The antenna unit 10 in FIG. 1 comprises an antenna 12 and an antenna case for covering the antenna 12. The antenna case comprises a dome-like top cover (which is depicted by a reference numeral 13 in FIG. 3) and a bottom plate 14 made of metal material and connected to the top cover 13. The antenna 12 is accommodated in the top cover.

The antenna 12 comprises an antenna element 20, a circuit board 22, and a shield case 24. The antenna element 20 illustrated in the figure comprises a patch antenna and receives a satellite wave. The circuit board 22 is provided with an electrical circuit (hereinafter called a signal processing circuit) for performing various kinds of signal processing, such as signal amplification, upon a reception signal received by the antenna element 20. The antenna element 20 is bonded on a first principal surface of the circuit board 22 by the use of a double-sided adhesive tape (not shown) or the like.

The circuit board 22 is connected to a cable (not shown) for extracting the reception signal to the outside of the antenna case. Further, a shield case 24 is attached to a second principal surface opposite to the first principal surface of the circuit board 22. The shield case 24 is made of metal or conductive material and secured to four corner portions of the circuit board 22 by soldering. Therefore, the shield case 24 is connected electrically to the circuit board 22 and serves to electromagnetically shield the signal processing circuit mounted on the circuit board 22.

The shield case 24 has an opening 24*a* for allowing a cable (not shown) to pass therethrough. The shield case 24 has a pair of tabs 241 extending outward from opposite side surfaces thereof. The tabs 241 are provided with through holes 24*b*, respectively.

The antenna unit 10 has a unit fixing member 30 disposed between the antenna 12 and the bottom plate 14. The unit fixing member 30 is made of plastic material. As will later be described in detail, the unit fixing member 30 serves to provisionally fix the antenna unit 10 onto the roof of the mobile object (car body) and to fix the antenna 12 onto the bottom plate 14. Thus, the unit fixing member 30 is disposed directly below the antenna 12.

On the other hand, the bottom plate 14 has a recess 141 adapted to receive the unit fixing member 30. The bottom plate 14 has three bosses 142 having three screw holes 142*a* to be screwed or engaged with three metal screws 26, respectively. Among the three bosses 142, the two bosses are formed at positions corresponding to the tabs 241 of the shield case 24.

The unit fixing member 30 has three boss receiving portions 31 formed at positions corresponding to the three bosses 142 of the bottom plate 14 and adapted to receive the three bosses 142. The boss receiving portions 31 are provided with communication holes 31*a* for penetration of the screws 26, respectively. The unit fixing member 30 has a hole 30*a* allowing the cable to pass therethrough. Further, the unit fixing member 30 has a pair of claws or hooks 32 extending downward to provisionally fix the antenna unit 10 to the roof of the mobile object (car body).

The bottom plate 14 is provided with a hole 141*a* formed in the recess 141 allowing the cable to pass therethrough and two holes 141*b* allowing the two claws 32 to pass therethrough.

Figure 2:
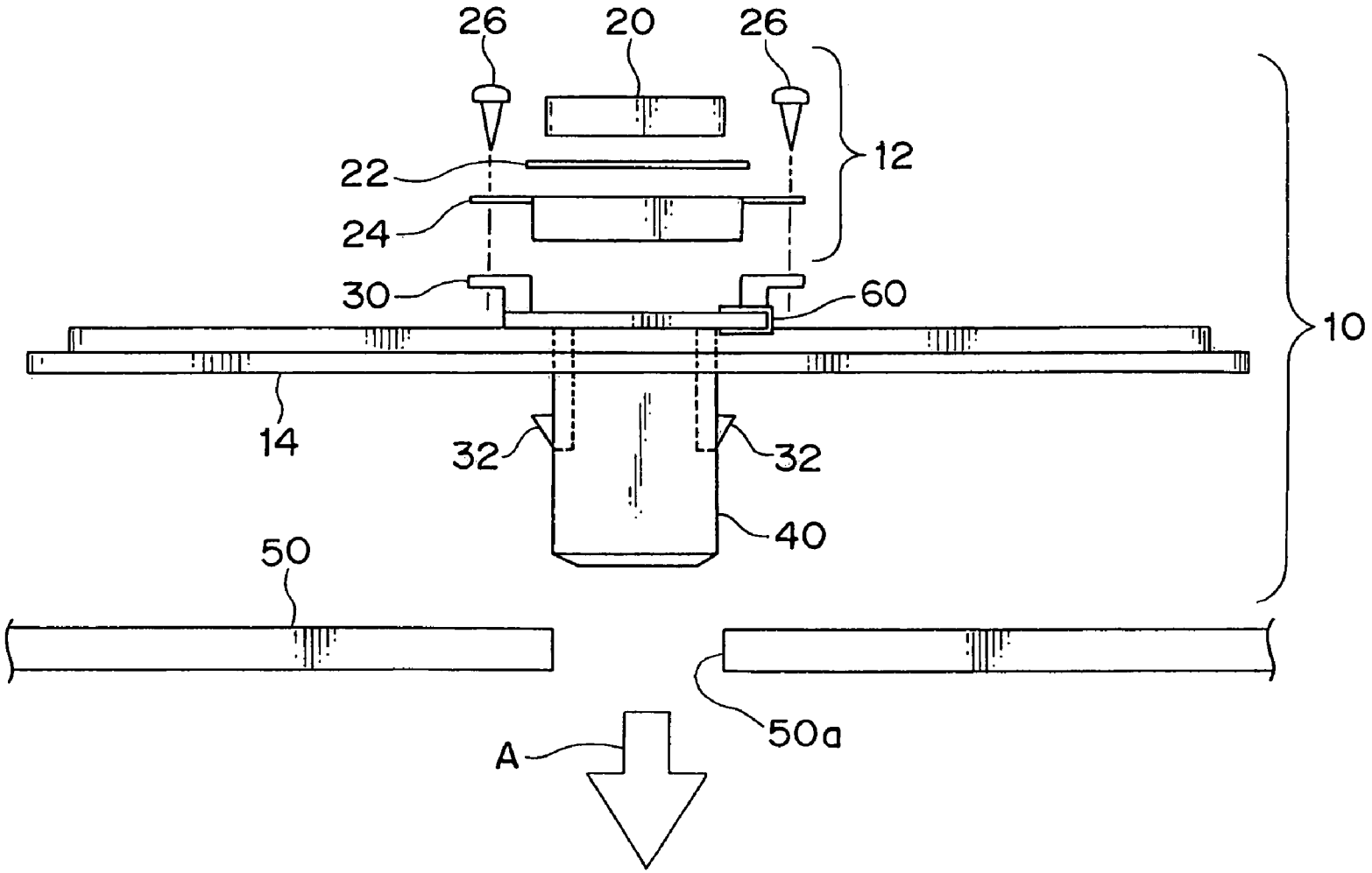
FIG. 2 is a sectional view for describing an operation of provisionally fixing the antenna unit in FIG. 1 onto a roof of a mobile object (car body)
Figure 3:
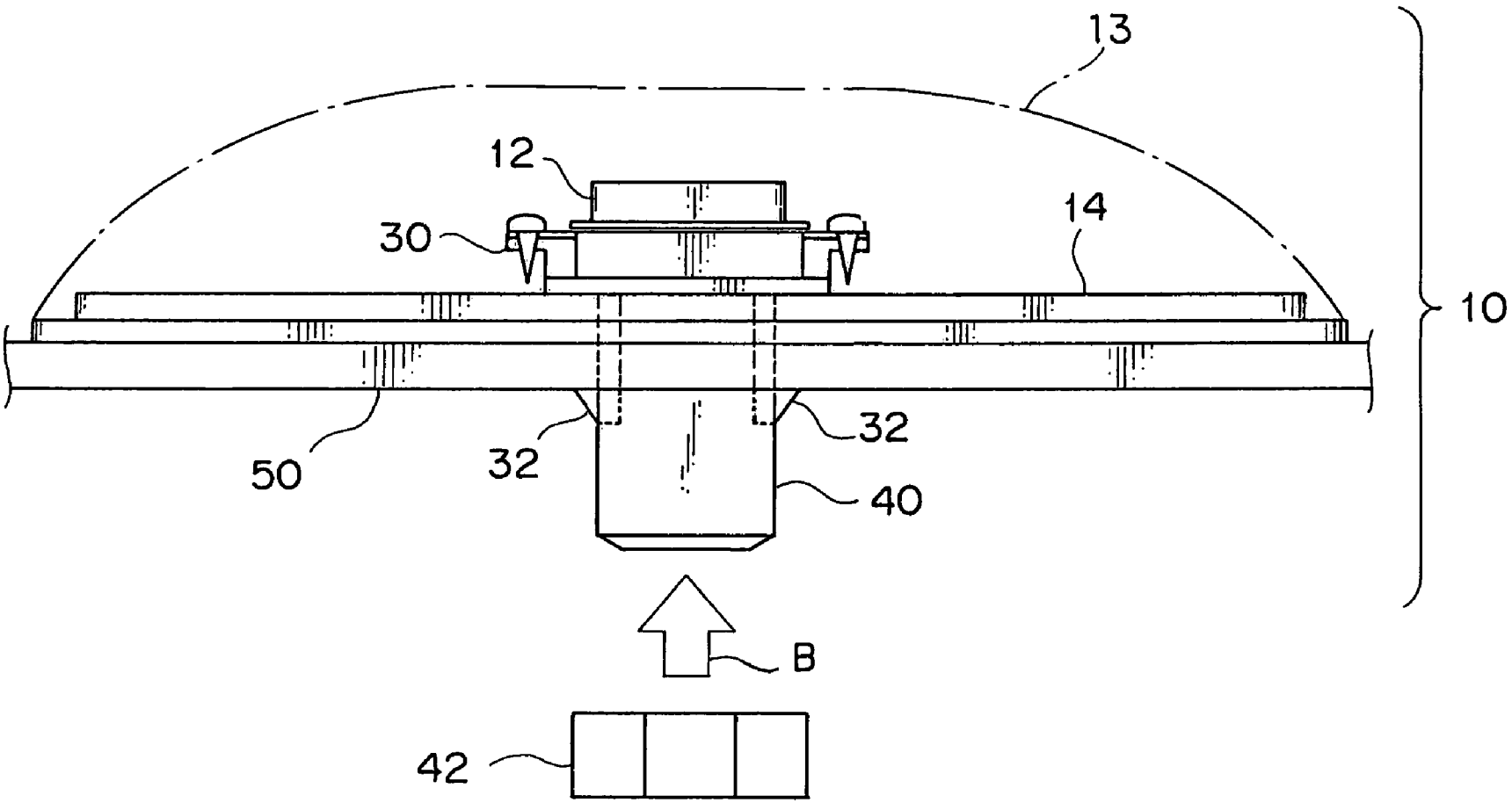
FIG. 3 is a sectional view for describing an operation of permanently fixing the antenna unit provisionally fixed in FIG. 2 onto the roof of the mobile object (car body)

Referring to FIGS. 2 and 3 in addition to FIG. 1, description will be made of an operation of fixing the antenna unit 10 of the above-mentioned structure to the roof of the mobile object (car body).

At first, as illustrated in FIG. 2, the claws 32 of the unit fixing member 30 are made to pass through the two holes 141*b* of the bottom plate 14, respectively. At this time, the three bosses 142 of the bottom plate 14 are inserted into the boss receiving portions 31 of the unit fixing member 30.

Next, as illustrated in FIG. 2, two of the three screws 26 are screwed in or engaged with two of the screw holes 142*a* of the bosses 142 through the through holes 24*b* of the shield case 24 and two of the three communication holes 31*a* of the unit fixing member 30. In addition, the remaining one of the screws 26 is screwed in or engaged with the remaining one of the screw holes 142*a* of the bosses 142 through the remaining one of the communication holes 31*a* of the unit fixing member 30. As a consequence, the antenna 12 is fixed onto the bottom plate 14 through the unit fixing member 30.

Then, as depicted by an arrow A in FIG. 2, a cylindrical bolt 40 extending downward from a lower surface of the bottom plate 14 is inserted into an opening 50*a* formed on the roof 50 of the mobile object (car body). Thus, as illustrated in FIG. 3, the antenna unit 10 is provisionally fixed onto the roof 50 of the mobile object (car body) by the claws 32 of the unit fixing member 30.

As depicted by an arrow B in FIG. 3, a nut 42 is engaged with the bolt 40 so that the antenna unit 10 is permanently fixed onto the roof 50 of the mobile object (car body). In addition, the top cover 13 is detachably mounted to the bottom plate so as to cover the antenna 12 and the unit fixing member 30.

As described above, in this embodiment, the unit fixing member 30 for provisionally fixing the antenna unit 10 onto the mobile object (car body) and for fixing the antenna 12 onto the bottom plate 14 is disposed directly below the antenna 12. Thus, the antenna unit 10 adopts an arrangement such that the unit fixing member 30 is overlapped with the antenna 12. As a consequence, a space required inside the antenna case can be reduced. It is therefore possible to provide the antenna unit 10 smaller in size and excellent in designability.

As shown in FIG. 2, a tape-shaped metal member 60 may be attached to extend along top, side, and bottom surfaces of the unit fixing member 30. With this structure, the shield case 24 is connected electrically to the bottom plate 14 through the metal member 60 to be enhanced with connection of the ground. In this case, the antenna is improved in reception sensitivity.

While the present invention has thus far been described in connection with the preferred embodiment thereof, it will readily be possible for those skilled in the art to put this invention into practice in various other manners. For example, it will readily be understood that the number of the bosses formed on the bottom plate, the number of the boss receiving portions formed on the unit fixing member, and the number of the tabs formed on the antenna (shield case) are not limited to those mentioned in the foregoing embodiment. The antenna unit described in the foregoing embodiment is suitable for use as an antenna unit for a digital radio receiver. However, without being limited thereto, this invention is applicable to an antenna unit for a GPS receiver, a mobile communication antenna unit for receiving other satellite waves and ground waves, and so on.

What is claimed is:

1. An antenna unit comprising:

an antenna;

a bottom plate which includes a plurality of bosses provided with respective screw holes; and a unit fixing member disposed between the antenna and the bottom plate, the unit fixing member being adapted to provisionally fix the antenna unit onto a mobile object and to fix the antenna onto the bottom plate, wherein the unit fixing member includes a plurality of boss receiving portions formed at positions respectively corresponding to the plurality of bosses, and the boss receiving portions comprise respective communication holes for penetration by screws to be engaged with the respective screw holes; and wherein the antenna includes a plurality of tabs provided with respective through holes for penetration by the screws to be engaged with the respective screw holes.

2. The antenna unit according to claim 1, wherein the bottom plate comprises a recess which receives the unit fixing member.

3. The antenna unit according to claim 1, wherein the unit fixing member comprises a pair of claws extending towards the bottom plate, and the bottom plate comprises two holes which allow the claws to pass therethrough.

4. The antenna unit according to claim 3, wherein the bottom plate comprises a space, between the holes with the claws passing therethrough, where a bolt is insertable to securely fix the antenna unit to the mobile object.

5. The antenna unit according to claim 1, further comprising a metal member attached to the unit fixing member, wherein the metal member is electrically connected to the antenna and the bottom plate.

6. The antenna unit according to claim 1, wherein the antenna comprises:

an antenna element;

a circuit board connected to the antenna element and having a signal processing circuit; and a shield case connected to the circuit board for electromagnetically shielding the signal processing circuit.

7. The antenna unit according to claim 6, wherein the circuit board is disposed between the antenna element and the shield case.

8. The antenna unit according to claim 7, wherein the unit fixing member is disposed between the bottom plate and the shield case.

9. The antenna unit according to claim 8, wherein each of the bottom plate and the shield case is made of a conductive material, and the unit fixing member is provided with a metal member which extends along a surface of the unit fixing member and which is electrically connected to the bottom plate and the shield case.

10. The antenna unit according to claim 7, wherein at least one metal screw is engaged with the bottom plate and the shield case for tightly fixing the shield case to the bottom plate through the unit fixing member.

11. The antenna unit according to claim 10, wherein an additional screw is engaged with the bottom plate and the unit fixing member for tightly fixing the unit fixing member to the bottom plate in cooperation with the at least one metal screw.

12. The antenna unit according to claim 1, further comprising a top cover cooperating with the bottom plate to form an antenna case for covering the antenna.

* * * * *